United States Patent [19]

Funke

[11] 4,191,437

[45] Mar. 4, 1980

[54] REFRIGERATOR STORAGE SYSTEM

[76] Inventor: Ludwig F. Funke, 7200 Newburgh Rd., Evansville, Ind. 47715

[21] Appl. No.: 910,733

[22] Filed: May 30, 1978

Related U.S. Application Data

[63] Continuation-in-part of Ser. No. 743,913, Nov. 22, 1976.

[51] Int. Cl.[2] ..... A47B 57/00

[52] U.S. Cl. ..... 312/305; 312/307; 108/94; 248/349

[58] Field of Search ..... 312/305, 135, 125, 202, 312/307, 214; 211/163; 108/94; 248/349

[56] References Cited

U.S. PATENT DOCUMENTS

| | | | |
|---|---|---|---|
| 836,947 | 11/1906 | Shidler | 108/94 |
| 1,687,149 | 10/1928 | Shauer et al. | 312/307 |
| 1,754,094 | 4/1930 | Glass, Sr. | 108/94 |
| 1,899,372 | 2/1933 | Walter | 312/307 |
| 1,941,906 | 1/1934 | Marinsky | 312/293 |
| 2,638,400 | 5/1953 | Spotts | 312/305 |
| 2,945,597 | 7/1960 | Romano | 108/94 |
| 3,063,714 | 11/1962 | Krauss | 248/349 |
| 3,104,139 | 9/1963 | Thompson | 108/94 |

*Primary Examiner*—Victor N. Sakran
*Attorney, Agent, or Firm*—Warren D. Flackbert

[57] ABSTRACT

A refrigerator storage system characterized by circular tracks located on shelving throughout the refrigerator for receiving rotatable shelves for the selective storage of food products. The arrangement affords versatility in food storage and the selection and withdrawal of the food items in a convenient manner.

8 Claims, 15 Drawing Figures

12
14a
12a
14b
14f
14
14e
12b 17c
19a
19
17b
17a
17c
17
20

14
12
14a
14e
12a 17
17a
20
19

REFRIGERATOR STORAGE SYSTEM

The present application is a continuation-in part of patent application Ser. No. 743,913, filed Nov. 22, 1976, with the same title and inventor.

As is known, considerable effort is being undertaken to afford optimum refrigerated storage for consumer food products, as in a household refrigerator. Typically, the latter contains a number of positionable shelving, generally of the wire type, and, as well, storage on surfaces defining the upper wall of the meat and produce containers. The latter may be in the form of smooth, roughened or ribbed glass or plastic. One drawback of a typical present arrangement is apparent when the desired food product is stored toward the rear of a shelf area, meaning a clumsy retrieval effort, sometimes time consuming and oftentimes annoying.

While rotating or "lazy susan" types of shelves have been previously considered and attempted, those in use involved superstructures which represented a problem to the consumer in removal for cleaning; were difficult, if at all possible, to adjust vertically; and, the center post thereof interfered with the placement of large food items, oftentimes reducing the usable storage space by fifty percent. Moreover, with the usual arrangement, the rotary shelves were as large as possible, meaning difficulty in reaching and storing items in the remaining rear corners.

The invention provides a refrigerator storage system representing versatility to the consumer's storage needs. Various shelving in the refrigerator includes a track, sometimes with a center of rotation which receives an axle or projection extending from the undersurface of a rotatable shelf. In order to achieve rotary movement of the shelf, wheels, balls or rollers are provided on the undersurface for traveling along the track.

The invention is applicable to both conventional wire or wire mesh type shelving and/or solid shelving surfaces, either in plastic or glass, where the track may be recessed for guidance if no axis of rotation is involved. In the instance of solid shelving surfaces, the wheels or balls of the rotatable shelf may move directly on the upper surface of the shelving, or in the instance of a roughened or ribbed shelf surface, the track can be formed thereon.

The importance of the invention lies in a presented storage system which affords considerable selection for the user. In this connection, the tracks for the rotatable shelves can be placed throughout the refrigerator, where the storage possibilities are then manyfold. No center post or other superstructure is involved and, therefore, problems are avoided inherent with that approach. In a typical invention form, the rotatable shelf may include openings for promoting air convection within the refrigerator.

A better understanding of the present invention will become more apparent from the following description, taken in conjunction with the accompanying drawings, wherein FIG. 1 is a perspective view showing a rotatable shelf arrangement for the refrigerator storage system of the invention;

Figures 1, 2, 3, 4:
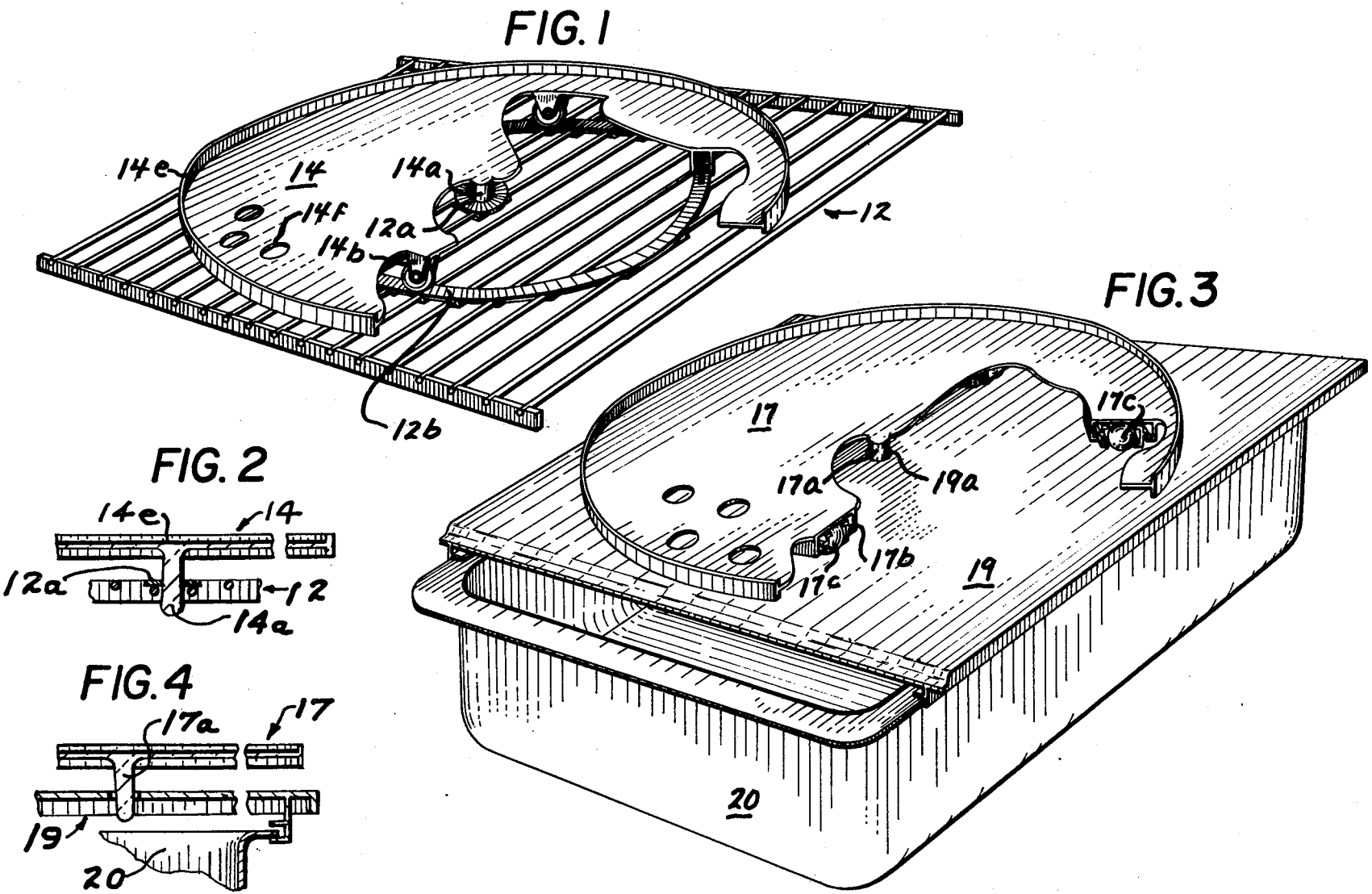
FIG. 2 is a fragmentary view in vertical section, showing the rotatable shelf of FIG. 1 when mounted for use.
FIG. 3 is another perspective view, in this instance showing an alternative form of rotatable shelf mounted on solid refrigerator shelving.
FIG. 4 is another fragmentary view in vertical section, showing the rotatable shelf of FIG. 3 when mounted for use.
Figure 5:
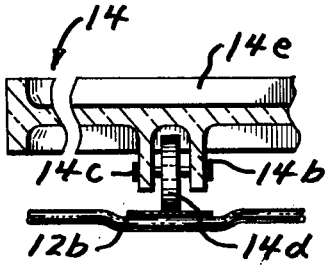
FIG. 5 is a view in elevation, showing a mounting wheel employed with the rotatable shelf of FIG. 1.
Figure 7:
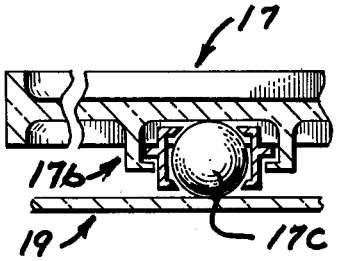
FIG. 7 is a view in elevation, partly in section, showing a mounting ball employed with the rotatable shelf of FIG. 3.
Figure 6:
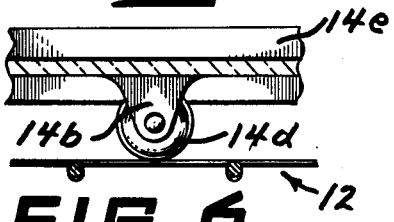
FIG. 6 is a view in side elevation, showing further details of the mounting wheel of FIG. 5.
Figure 8:
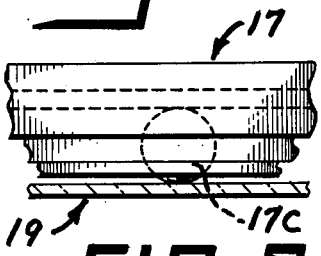
FIG. 8 is a view in side elevation, looking from left to right in FIG. 7, showing further details of the mounting ball of FIG. 7.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications of the illustrated devices and such further applications of the principles of the invention as illustrated therein being contemplated as would normally occur to one skilled in the art to which the invention relates.

Referring now to FIGS. 1, 2, 5 and 6, a typical rotatable shelf arrangement is illustrated which forms a part of the refrigerator storage system of the invention. In this connection, a conventional wire type shelf 12 includes a guide **12*a* defining a center of rotation and a track 12*b* in the form of a continuous strip or band. The center guide 12*a* and the track 12*b* are typically recessed into the wires forming the shelf 12 (see FIG. 5**), so that food items may be smoothly moved thereon.

A rotatable shelf 14 is used in conjunction with the center guide **12*a* and the track 12*b*. In this connection, the undersurface of the rotatable shelf 14 has a downwardly projecting pivot 14*a* which is received in the center guide 12*a*, where downwardly depending flanges 14*b* each receive an axle 14*c* for a wheel 14*d*. In other words, the preceding permits the rotation of the rotatable shelf 14, where the guide 12*a* serves to define the axis of rotation and the wheels 14*d* serving load supporting purposes, travel along the track 12*b***.

As to the rotatable shelf 14, such is typically made from a plastic resin and may include openings **14*f* in the storage surface thereof to permit air convection within the refrigerator. Additionally, a rim 14*e* is disposed along the edge of the rotatable shelf 14**, serving to confine and position food items thereon.

Looking at FIGS. 3, 4, 7 and 8, an alternative form of rotatable shelf 17 is shown, in this instance in combination with a conventional solid shelf 19. The latter, typically made from plastic or glass, serves as an upper wall for covering and supporting a slidable produce or meat container 20.

The rotatable shelf 17 includes a downwardly projecting central pivot 17*a* adapted to be received in a corresponding opening 19*a* in the shelf 19. The undersurface of rotatable shelf 17 includes a continuous depending support structure 17*b* (not fully shown in FIG. 3, but also see FIG. 7) for receiving and mounting balls 17*c*. The balls 17*c* ride on the upper surface of the shelf 19, if the surface is smooth, or on a smooth track (not shown) formed in the upper surface if such is roughened or ribbed.

Figure 9:
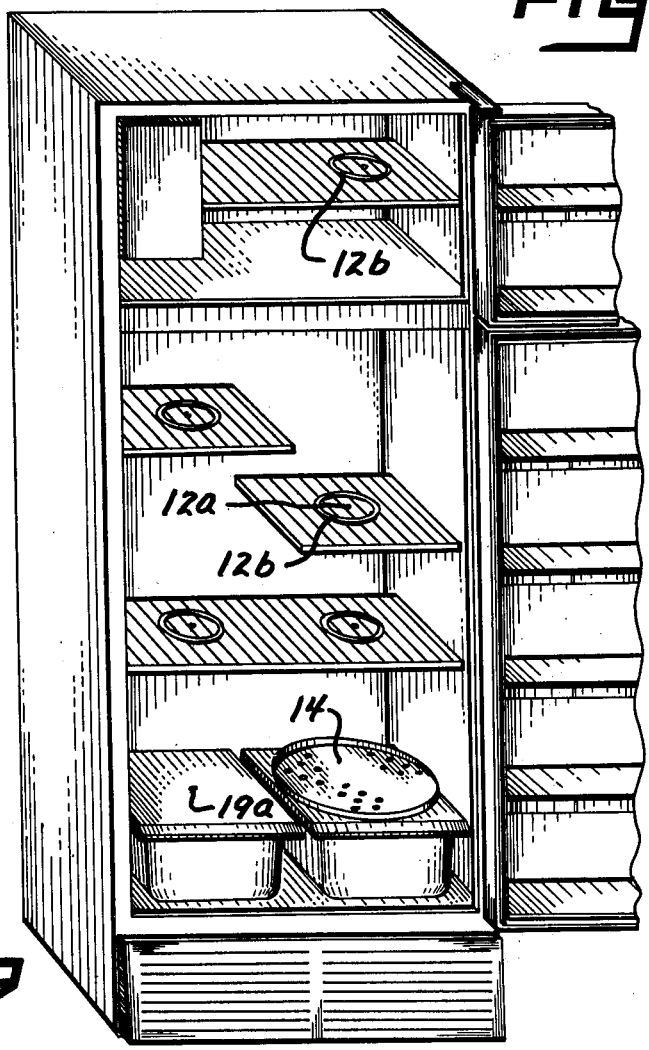
FIG. 9 is a perspective view showing the overall refrigerator storage system of the invention.

FIG. 9 discloses a conventional household refrigerator utilizing the storage system of the invention. In this connection, center guides 12*a* or openings 19*a* and tracks 12*b* are shown on various shelving, where appropriate, either of the wire or solid type. A rotatable shelf, with wheels (14) or with balls (17) may be interchangeably moved to any of the indicated locations. While not shown, several rotatable shelves may also be employed.

FIG. 9 demonstrates the versatility of the invention in providing a flexible and personalized storage arrangement. It should be noted that no superstructure or obstructing center shaft is involved and the rotatable shelf may be readily moved from one location to another. Moreover, the entire storage area of the rotatable shelf may be employed, and various size food items stored. When a rotatable shelf is not used, the shelving may be used in a conventional manner.

FIGS. 10 to 15, inclusive, are directed to an invention form where no downwardly projecting pivot is required on the rotatable shelf 14–17. In this connection, the track on either the wire shelf 12 or the solid shelf 19 is in the form of a channel, meaning that the wheels or rollers 14*d*–17*c* carried by the rotatable shelf are properly positioned, or laterally channeled, for "lazy susan" movement. Restated, the track serves positioning purposes without the necessity of the pivot receiving opening in the shelf shown in the first disclosed form.

Figure 10:
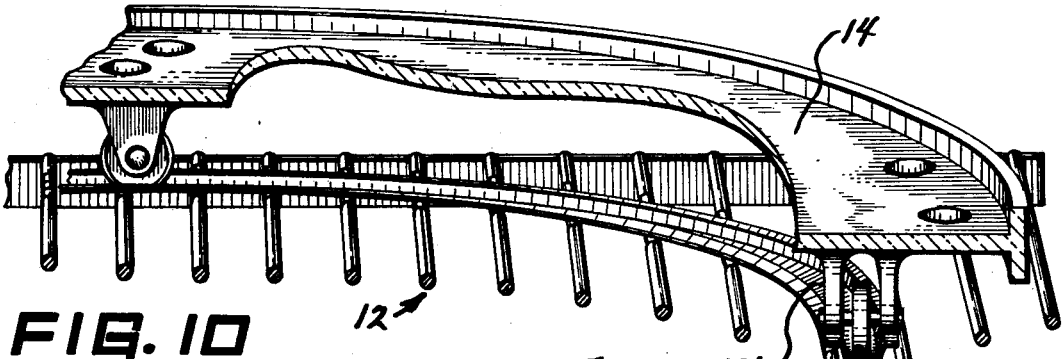
FIG. 10 is a fragmentary perspective view showing a form of the invention where the rotatable shelf does not include a projecting pivot member.
Figure 13:
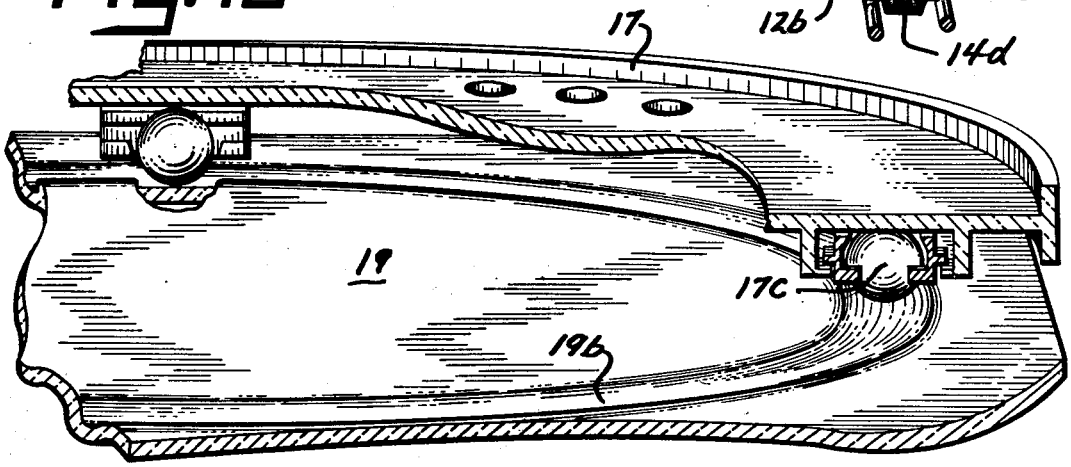
FIG. 13 is another cross-sectional view showing a still further form of the invention.
Figure 11:
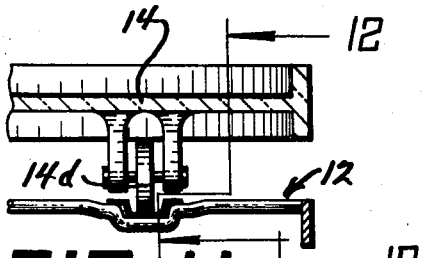
FIG. 11 is a cross-sectional view through the arrangement of FIG. 10.
Figure 14:
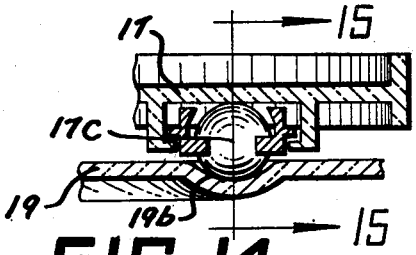
FIG. 14 is a cross-sectional view through the arrangement of FIG. 13; and, FIG. 15 is another cross-sectional view, taken at line 15—15 on FIG. 14 and looking in the direction of the arrows.
Figure 12:
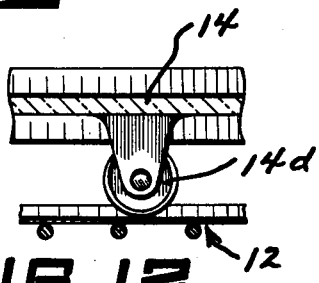
FIG. 12 is a further cross-sectional view, taken at line 12—12 on FIG. 11 and looking in the direction of the arrows.
Figure 15:
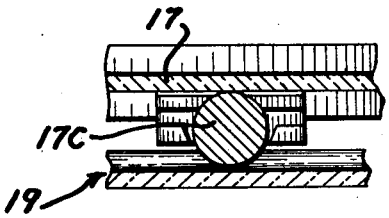

FIGS. 10, 11 and 12 are directed to a wire shelf 12, where the track 12*b* (see FIG. 10) receives the wheels 14*d*. In FIGS. 13, 14 and 15, a solid shelf 17 is disclosed, where the rollers or balls 17*c* on the undersurface of the rotatable shelf 17 travel along a rounded recessed track 19*b*.

In any event, the refrigerator storage system described above is susceptible to various changes within the spirit of the invention. By way of example, the mounting arrangement for shelf rotation may be varied, the rotatable shelf reproportioned, and the like. Thus, the preceding description should be considered illustrative and not as limiting the scope of the following claims:

I claim:

1. A rearrangeable storage system for a refrigerator having a plurality of storage shelves comprising at least one removable and rotatable shelf adapted to travel a 360° path within the confines of a supporting storage shelf, load supporting means arranged on the undersurface of said rotatable shelf outwardly of the rotational axis thereof, tracks disposed on said storage shelves for rolling engagement by said mounting means to achieve various storage arrangements with the relocation of said rotatable shelf, and means maintaining said rotatable shelf at a preselected position on said storage shelves, where unobstructed space is provided between said rotatable shelf and the next adjacent upper storage shelf, where portions of said storage shelves remain usable when said rotatable shelf is at said preselected position on said storage shelves, and where the full areas of said storage shelves remain usable after any relocation of said rotatable shelf.

2. The storage system of claim 1 where said load supporting means includes wheels.

3. The storage system of claim 1 where said load supporting means includes balls.

4. The storage system of claim 1 where said load supporting means includes rollers.

5. The storage system of claim 1 where said maintaining means is a pivot member extending downwardly from the undersurface of said rotatable shelf, and where openings in said storage shelves selectively receive said pivot member.

6. The storage system of claim 5 where said pivot member receiving opening is in a solid shelf serving as the top of an existing food storage compartment.

7. The storage system of claim 1 where said tracks are recessed to define said maintaining means.

8. The storage system of claim 1 where said tracks define channels representing said maintaining means.

* * * * *

UNITED STATES PATENT AND TRADEMARK OFFICE

CERTIFICATE OF CORRECTION

PATENT NO. : 4,191,437

DATED : March 4, 1980

INVENTOR(S) : LUDWIG F. FUNKE

It is certified that error appears in the above—identified patent and that said Letters Patent is hereby corrected as shown below:

In claim 1, column 4, line 19, delete "mounting" and insert --load supporting-- .

Signed and Sealed this

*Fifteenth* Day of *July 1980*

[SEAL]

*Attest:*

SIDNEY A. DIAMOND

*Attesting Officer*

*Commissioner of Patents and Trademarks*